US006520808B2

(12) United States Patent
Forbes et al.

(10) Patent No.: US 6,520,808 B2
(45) Date of Patent: Feb. 18, 2003

(54) ANTI-CROSSTALK CONNECTOR

(75) Inventors: Harry Forbes, Southampton (GB); David Ralph Pinney, Hungerford (GB); William Douglas Mackenzie, Fleet (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/846,549

(22) Filed: Apr. 26, 2001

(65) Prior Publication Data

US 2002/0019172 A1 Feb. 14, 2002

Related U.S. Application Data

(63) Continuation-in-part of application No. PCT/GB99/03596, filed on Oct. 29, 1999.

(30) Foreign Application Priority Data

Nov. 4, 1998 (GB) ..... 9824165

(51) Int. Cl.[7] ..... H01R 24/00
(52) U.S. Cl. ..... 439/676; 439/941
(58) Field of Search ..... 439/696, 941

(56) References Cited

U.S. PATENT DOCUMENTS

| | | | | |
|---|---|---|---|---|
| 5,547,405 A | | 8/1996 | Pinney et al. | 439/894 |
| 5,626,497 A | * | 5/1997 | Bouchan et al. | 439/676 |
| 5,769,647 A | | 6/1998 | Tulley et al. | 439/144 |
| 5,791,943 A | * | 8/1998 | Lo et al. | 439/491 |
| 6,290,524 B1 | * | 9/2001 | Simmel | 439/289 |

* cited by examiner

*Primary Examiner*—Tulsidas Patel
(74) *Attorney, Agent, or Firm*—Roger C. Turner

(57) ABSTRACT

A connector with at least two pairs of contacts is provided, wherein crosstalk between first and third contacts, which are separated by a second contact, is reduced by a lateral extension of the third contact. The lateral extension includes a suppressing section extending parallel and adjacent to the first contact, and a pair of connecting sections that each connects one end of the suppressing section to the rest of the third contact. This allows at least some current passing along the third contact, to pass through the suppressing section and induce anti-crosstalk currents in the first contact to counter crosstalk. At least one connecting section has a lengthening portion that increases its length to create a phase shift. The suppressing section has a minimal width compared to its height. For a stamped sheet metal contact, the width is less than twice the height to reduce capacitive coupling while maintaining inductive coupling.

16 Claims, 12 Drawing Sheets

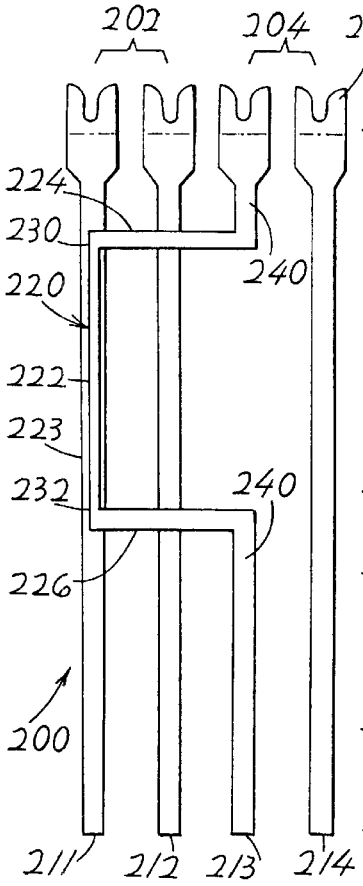
FIG. 1A
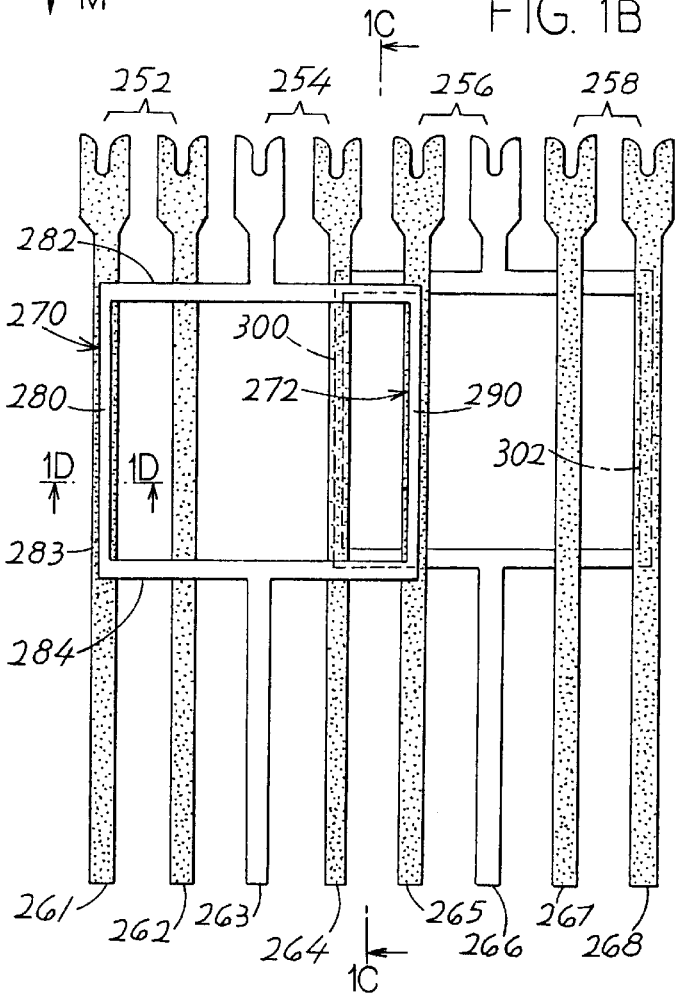
FIG. 1B
FIG. 1C
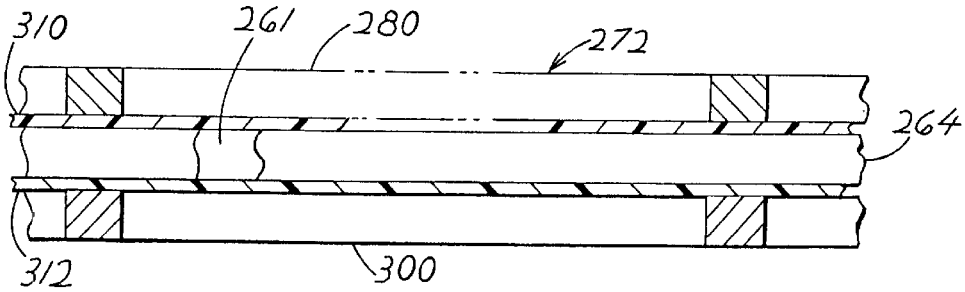

FIG 14
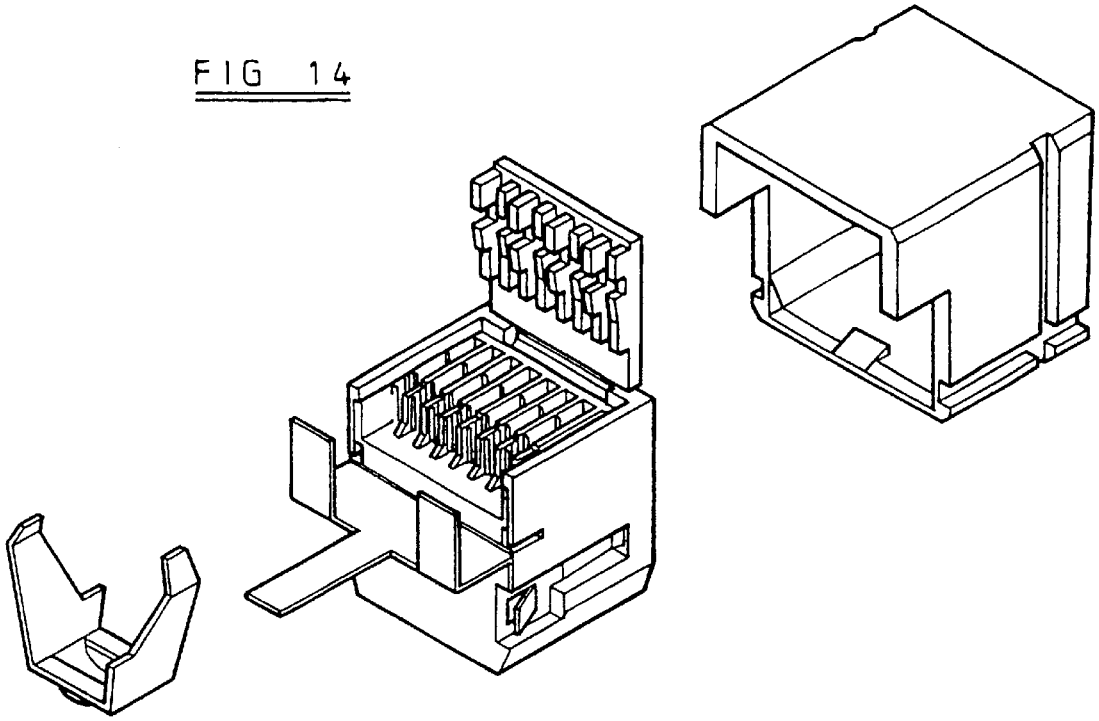
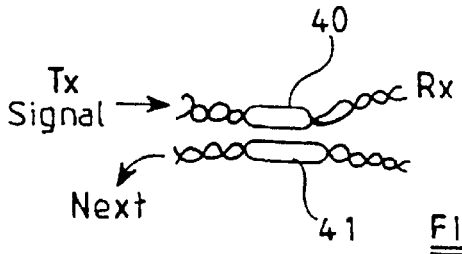
FIG 15
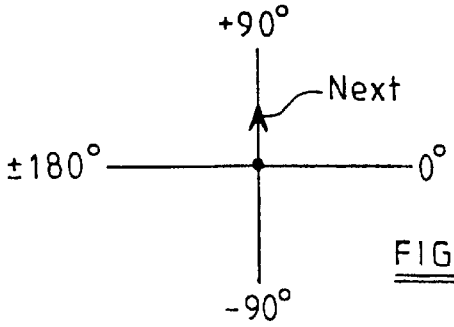
FIG 16

ANTI-CROSSTALK CONNECTOR

CROSS-REFERENCE TO RELATED APPLICATION

This is a continuation-in-part of PCT/GB99/03596 filed Oct. 29, 1999 which names the U.S., and which claims priority from Great Britain patent application 9824165.6 filed Nov. 4, 1998.

BACKGROUND OF THE INVENTION

This invention relates to an electrical connector In which crosstalk between two or more pairs of signal carrying contacts is reduced.

There is a problem in connectors with multiple pairs of conductors, where each pair is required to carry individual signals, as there is the risk of cross coupling of signals due to electrostatic (capacitive) and magnetic (induction) coupling. Such cross coupling is called crosstalk and becomes worse as frequencies of signals are increased. The crosstalk results from the capacitive and inductive coupling between nearest lines of two pairs, which dominates the opposite phase and canceling effect from the furthest lines of the pair, of a balanced two wire system. This results in effectively a differential coupling of each line of each pair and the lines of the other pair. The problem is sometimes worsened by wiring conventions for example in the EIA/TIA 568B wiring practice for an eight contact in line connector, contacts 1 & 2 form the orange pair, contacts 3 & 6 form the green pair, contacts 4 & 5 form the blue pair and contacts 7 & 8 form the brown pair. It will be appreciated that in such a configuration crosstalk is a major problem between blue and green pairs as each line of each pair lies adjacent a line of the other pair and there is electrostatic and electromagnetic coupling between them. To a lesser extent there is coupling between green and both orange and brown because one line of each pair lies adjacent a line of the other pair.

Attempts have been made to reduce the effect of crosstalk in adjacent lines of electrical connectors. For example in U.S. Pat. No. 5,547,405 by Pinney (present inventor), et al., owned by the present assignee, there is disclosed an electrical connector which has four contacts extending between input terminals and output terminals. In order to reduce crosstalk between pairs of contacts a lateral extension from one contact overlies a second contact. The lateral extension does not carry current but provides capacitive coupling between the contacts to produce crosstalk in opposition to crosstalk induced between the mutually closest terminals. Whilst the construction described in that patent specification provides some cross talk compensation and is relatively simple to manufacture it has been discovered that improvements in cross talk cancellation are possible. The present invention seeks to provide a connector having improved crosstalk cancellation.

SUMMARY OF THE INVENTION

According to the invention there is provided an electrical connector comprising at least four contacts extending between input and output terminals, in which the mutually most distant contacts of different particular assigned signal carrying pairs of said contacts is arranged to provide coupling therebetween to induce compensating crosstalk. The compensating crosstalk is in opposition to crosstalk induced between the mutually closest contacts of the different assigned signal carrying pairs, wherein the path lengths of the mutually most distant contacts are extended to enhance a phase opposition relationship between the mutually opposed cross talks, thereby to reduce overall crosstalk.

A third contact of a group of four primarily longitudinally extending contacts has a lateral extension. The extension includes a suppressing section that extends parallel and adjacent to a first contact of the group. A pair of connecting sections each connects an end of the suppressing section to the third contact, and has a part that extends across a second contact that lies between the first and third contacts. One of the connecting sections can have a lengthening portion to cause a phase shift. The width of the suppressing section is less than twice its height, to minimize capacitive coupling.

In order that the invention and its various other preferred features may be understood more easily, embodiments thereof will now be described, by way of example only, with reference to the drawings.

BRIEF DESCRIPTION OF THE DRAWINGS

FIG. 1A is a simplified plan view of a connector of the invention with two pairs of contacts.

FIG. 1B is a simplified plan view of a connector with four pairs of contacts.

FIG. 1C is a sectional view taken on line 1C—1C of FIG. 1B, and showing dielectric layers between overlying contacts.

FIG. 14 shows the component parts of the connector assembled in readiness for the connection of insulated wires.

FIG. 15 illustrates schematically two side by side transmission lines.

FIG. 16 illustrates the phase relationship of cross coupling between the transmission lines of FIG. 15.

DESCRIPTION OF THE PREFERRED EMBODIMENTS

1. Limited Description

Figure 1:
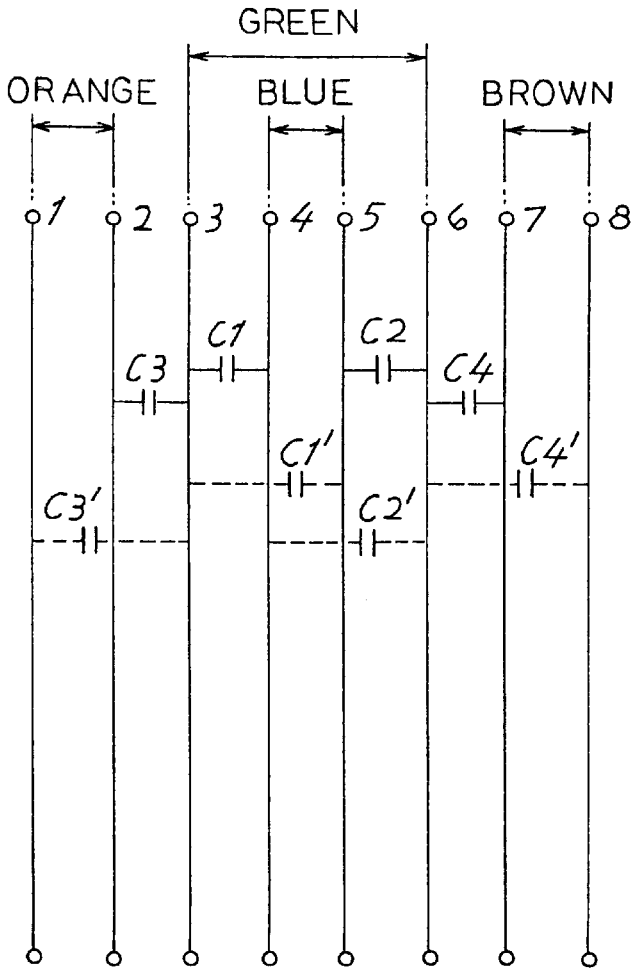
FIG. 1 is a schematic diagram illustrating the major problem of crosstalk occurring in an eight contact connector.

FIG. 1A is a simplified view of a connector 200 of the present invention which includes two pairs 202, 204 of contacts 206. The four contacts 211, 212, 213, 214 each carry high frequency signals (1 MHz to a few hundred MHz and beyond) that result in crosstalk. If the third contact 213 extended solely in a longitudinal M direction, as do the other contacts, then there would be substantial crosstalk between the adjacent contacts 212, 213, but there would not be much crosstalk between contacts 211 and 213 to counter the crosstalk between contacts 212 and 213. Applicant counters the crosstalk between adjacent contacts 212 and 213 of the different pairs, by constructing the third contact 213 with a lateral extension 220.

The lateral extension 220 includes a suppressing section 222 and a pair of connecting sections 224, 226. The suppressing section 222 extends parallel and closely adjacent to a portion 223 of the first contact 211 to provide good inductive coupling between them. As a result, current passing through the suppressing section 222 induces a current in the first contact 211. If the connector is properly constructed, the current induced in the first contact 211 by current flowing through the suppressing section 222, will produce a crosstalk that will counter the crosstalk produced in the other contact 212 of the pair to minimize the overall crosstalk effect. Each connecting section 224, 226 connects an end 230, 232 of the suppressing section to the rest 240 of the first contact 213 that extends generally longitudinally M. It is noted that each connecting section 224, 226 extends across the intermediate or second contact 212. However, the direction of current flow through those parts of the connecting sections that overlie the second contact 212, extend primarily perpendicular to the direction of current flow through the second contact, and extend a short distance, so the effect on the second contact is minimal. It is noted that there is a thin layer of dielectric material between the suppressing section 222 and the portion 223 of the first contact 211 that the suppressing section overlies, to prevent direct engagement of the first and third contacts.

FIG. 1B shows a connector with four sets of contacts 252, 254, 256 and 258, comprising eight contacts 261–268. The third contact 263 has two lateral extensions, including left and right lateral extensions 270, 272. The terms "left" and "right" merely denote the positions as seen in FIG. 1 B. The left extension 270 has a suppressing section 280 and a pair of connecting sections 282, 284. The suppressing section 280 extends parallel to a portion 283 of the first contact 261 and lies adjacent to it, with a layer of dielectric between them. Similarly, the right extension 272 has a suppressing section 290 extending parallel and adjacent to a portion of the fifth contact 265 and has a pair of connecting sections. Half of the current passing through the third contact 263 passes along each suppressing section 280, 290.

The sixth contact 266 has left and right extensions 300, 302 with suppressing sections extending parallel and adjacent respectively to the fourth contact 264 and to the eighth contact 268.

FIG. 1C shows that a dielectric layer 310 lies between the first suppressing section 280 and the first contact 261. That dielectric layer also lies between the second suppressing section 290 and the fifth contact. Another dielectric layer 312 lies between a suppressing section of lateral extension 300 and the fourth contact 264.

Figure 1D:
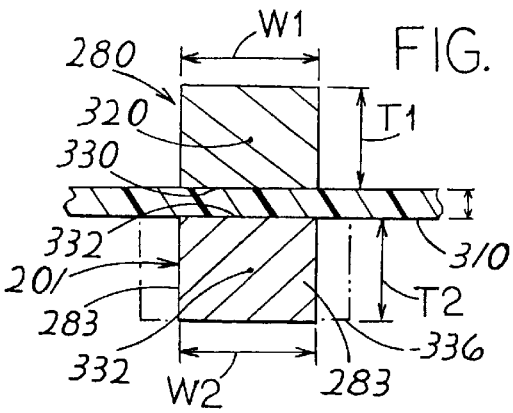
FIG. 1D is an enlarged sectional view taken on line 1D—1D of FIG. 1B.

FIG. 1D is a sectional view showing the suppressing section 280 of the left extension of the third contact extending parallel and adjacent to the section 283 of the first contact 201. The first dielectric layer portion 310 lies between them to prevent their direct engagement. Longitudinally-extending lines 320, 332 represent the paths of current, and show that the current paths of the suppressing section 280 and of the first contact portion 283 are parallel and lie close together. Such closeness of the current paths results in a high level of inductive coupling of the suppressing section 280 to the first contact to induce currents in the first contact 201 that counter crosstalk.

The contacts are formed of sheet metal that has been blanked from a larger piece of sheet metal, of material such as phosphor bronze or beryllium copper. This results in the contacts having flat faces 330, 332, except for imperfections due to the blanking process. The flat faces abut the dielectric layer 310 and face each other. The closeness of the faces 330, 332 results in capacitive coupling of the suppressing section 280 and first contact section 332. When inductive coupling is achieved in the illustrated manner, the relatively strong capacitive coupling is undesirable, and it is desirable to reduce such capacitive coupling to a lower level. It is noted that increased inductive coupling and reduced capacitive coupling, to achieve a balance of such couplings, is desirable primarily for reduction of far end crosstalk (FEXT), which is crosstalk appearing at a distant receiver.

The thickness T1, T2 of the adjacent contacts is determined largely by the fact that the particular contacts have ends that are IDC (insulation displacement contacts) that require a moderate thickness for rigidity. The widths W1, W2 of the contacts have been chosen to make cutting out of the contacts easy without excessive width that would increase the amount of material used and appreciably increase the width of the connector. Typical prior art sheet metal contacts have a width that is about three to four times the thickness of the sheet metal.

The capacitive coupling between the suppressing section 280 and section 283 of the first contact is substantially proportional to the width of the narrowest of the contacts, which determines the area of the contacts that lie adjacent and face each other. The inductive coupling of the contacts remains the same as the width increases or decreases.

In accordance with the invention, applicant minimizes the width of the adjacent portions, or at least one of them, to thereby minimize the capacitive coupling while not changing the inductive coupling. Applicant constructs the suppressing section 280 so its width W1 is the minimum that can be achieved with low to moderate cost manufacturing techniques. Applicant found that with a thickness T1 of 0.3 mm, that the minimum width W1 that could be mass produced at moderate cost by available suppliers was 0.48 mm. Applicant could not find suppliers who could produce a smaller width than this for the sheet metal of 0.3 mm thickness. This results in a width W1 that is 160% of the thickness T1. Such a width is less than the common width such as three to four times the thickness that is usually obtained when width is not of importance. The width of the adjacent section 283 of the first contact can be increased as to a width at 336 which is twice the thickness T2, or even more, without appreciable change in capacitance between the contacts.

Figure 1E:
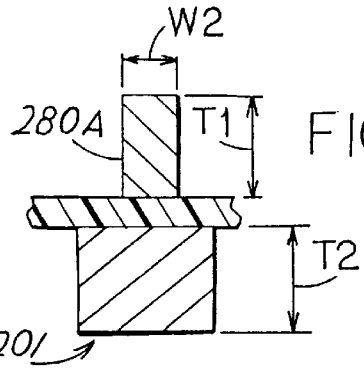
FIG. 1E is an enlarged view similar to FIG. 1D, but of another embodiment.

FIG. 1E shows a suppressing section 280A and first contact 201, where the thickness T1 is the same thickness of 0.3 mm as in FIG. 1D, but where the width W2 is only 0.15 mm. This results in a width that is half that of the thickness. Such a suppressing section 280A results in much lower capacitance between itself and the first contact 201, but with the same inductive coupling, resulting in a balance between inductive and capacitive coupling that is closer to optimum. However, such a suppressing section 280A may require such section to be constructed as by machining rather than by mass production blanking of the contact from a sheet of metal which results in a much lower cost than machining. Thus, applicant prefers that the suppressing section 280 or 280A have a width W1 that is less than 200% and preferably less than 180% of the thickness T1 of the suppressing section. It is even preferred that the width W2 be less than 100% of the thickness T1, although this is difficult to achieve. It is noted that such ratio can be achieved with a round wire, but such round wire cannot be easily formed with an end forming an effective IDC.

Figure 1F:
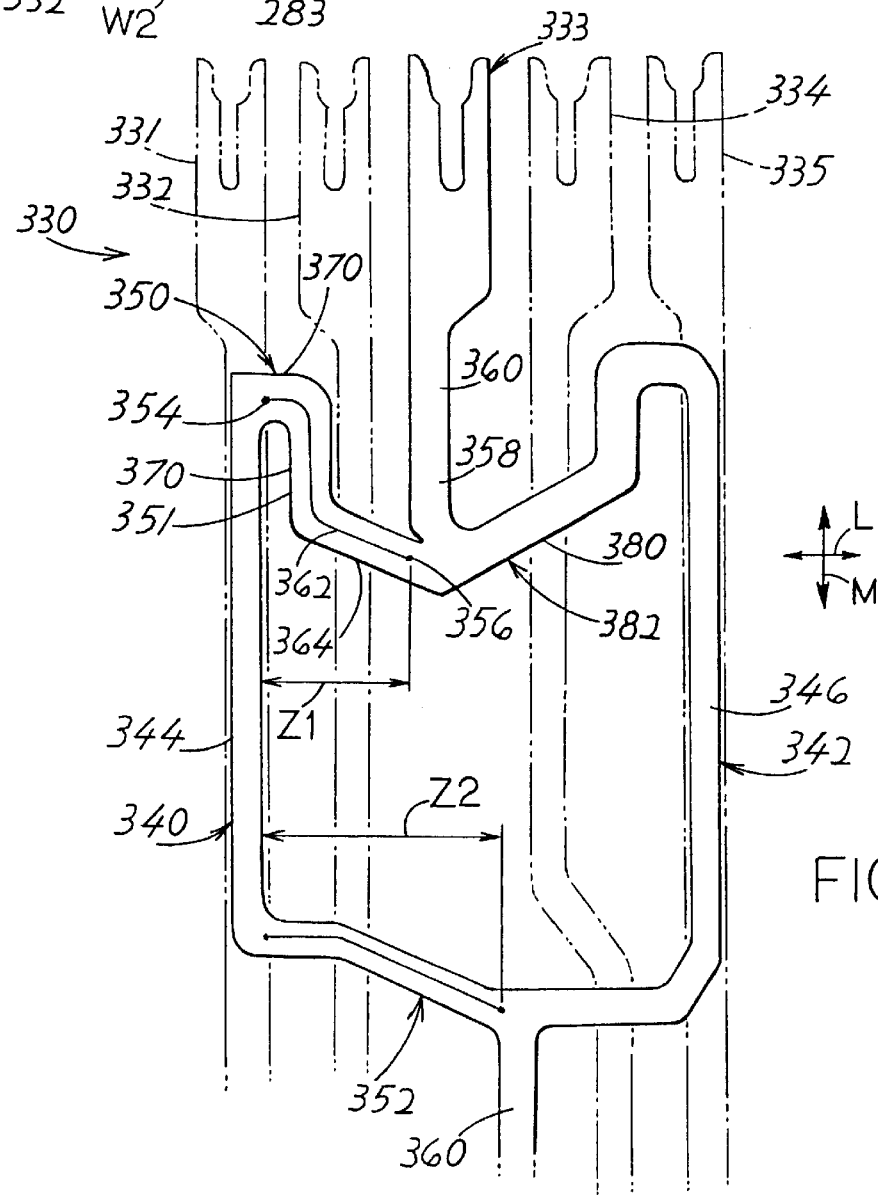
FIG. 1F is a plan view of a connector where a lateral extension is provided with a lengthening portion to produce a phase delay.

FIG. 1F shows five contacts 331–335 of a group 330 of contacts, and shows the shape of the third contact 333. The third contact has a pair of extensions 340, 342 with suppressing sections 344, 346 that overlie sections of the first and fifth contacts 331, 335. The left extension 340 includes connecting sections 350, 352. Connecting section 350 includes a lengthening portion 351 that extends the length between a corresponding end 354 of the suppressing section 344 and a corresponding end 356 of an adjacent part 358 of the rest 360 of the third contact. The length of the current path 362 along the lengthened connecting section 350 is more than 110% of the direct lateral L distance Z1 between the main part end 356 and the suppressing section 344. In actuality, the lengthening portion is in the form of a fold back with an inclined part 364 and with a part 370 that extends primarily parallel to the suppressing section 344 but that is spaced from close facewise adjacency, from both the first and second contacts. The actual length of the lengthened connecting section 350 is 150% to 160% of the direct length Z1. A length at least 110% greater, and usually at least 120% greater than the direct length Z1 results in a significant phase shift of the current passing along the suppressing section 344 in order to have that current lie close to 180° out of phase with crosstalk to be suppressed in the first pair of contacts. The lengthening section preferably is sheet metal lying in the same plane as adjacent parts of the contact at 360, although this is not necessary.

The right extension 342 is of largely similar construction, although its inclined part 380 of its connecting section 382 is longer. Applicant can determine the required percent increase in length of the connecting section over a direct lateral connecting section, by measuring the crosstalk and adjusting the length of the connecting section until the crosstalk is a minimum.

It is noted that the connecting section 352 extends the direct length Z2 by extending at an incline to a direction perpendicular to the suppressing section 344.

While terms such as "left", "right", "overlie", etc. have been used to describe the relative orientations of parts as they are illustrated, it should be understood that the parts can be used in any orientation relative to the Earth.

2. More Complete Description

Figure 2:
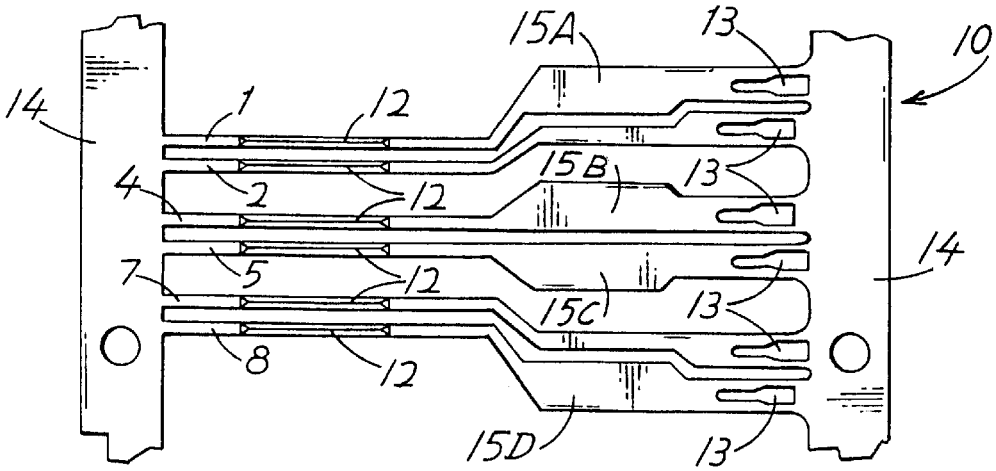
FIG. 2 is a plan view of a lead frame for providing six of the terminals of a connector.
Figure 3:
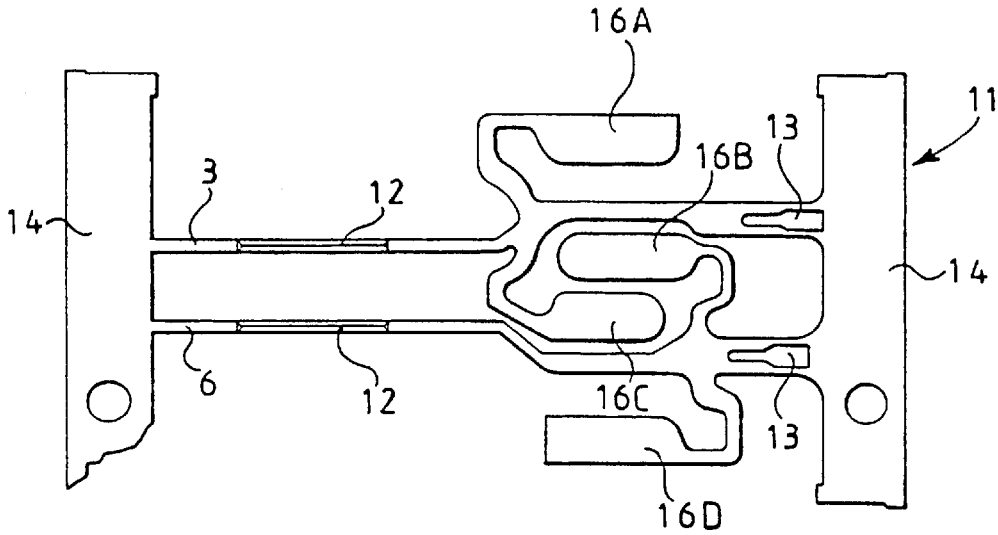
FIG. 3 is a plan view of a second lead frame for providing two additional terminals of a connector.

Referring to FIG. 1 there is illustrated an eight terminal in line connector intended for use with the EIA/TIA 568B wiring practice. As can be seen the lines 4 & 5 and 3 & 6 are close to each other and crosstalk is induced between them by electromagnetic and electrostatic coupling the capacitive element of which as simulated by capacitors $C_1$ & $C_2$. In order to compensate for such crosstalk, compensating crosstalk can be introduced between 3 & 5 and 4 & 6 which is in antiphase (about 180% out of phase) to the unwanted crosstalk induced between the adjacent lines. This can be done by providing increased capacitive coupling between 3 & 5 and 4 & 6 as is shown in broken lines and identified as $C_1'$ and $C_2'$ respectively. There is also crosstalk between the lines 2 & 3 and 6 & 7 of adjacent pairs of terminals as represented by $C_3$ and $C_4$ and this can be similarly compensated by providing increased capacitive coupling between 1 & 3 and 6 & 7 as is shown in broken lines and identified as $C_3'$ and $C_4'$ respectively. The present invention is concerned with providing such compensation in a connector having four or more terminals. Referring now to FIG. 2 there is shown in plan view a lead frame 10 formed by pressing from a thin sheet of metal e.g. beryllium copper to define six terminals numbered 1,2,4,5,7,8. FIG. 3 shows a plan view of another lead frame 11 of the prior art similarly formed to define two terminals 3 & 6. In both lead frames one end of each of the terminals is formed as an elongate tail 12, the tails running in a substantially mutually parallel disposition, and the other end is provided with an elongate cut out 13 which when separated from side rail 14 defines the fork of an insulation displacement connector. It will be seen in FIG. 2 that the terminals 1,4,5 & 8 have portions 15A, 15B, 15C & 15D respectively of greater width and surface area which are intended for cooperation with lateral extensions 16A, 16B & 16C, 16D provided on terminals 3 & 6 respectively as will be seen from FIG. 3.

Figure 4:
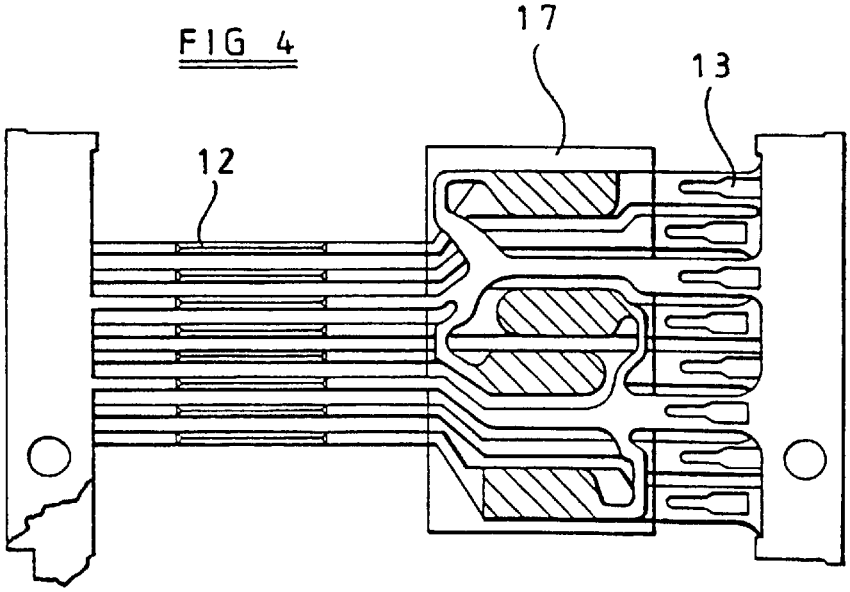
FIG. 4 is a plan view showing the arrangement of the lead frames of FIGS. 3 & 4 mounted one on each side of an insulating dielectric film.

Referring now to FIG. 4 there is shown in plan view how the two lead frames are mounted one on top of another separated by an insulating film 17. In the illustration the lead frame 10 is shown on the bottom and is separated from the lead frame 11 by a transparent film for ease of illustration. The film may be of any suitable dielectric material for example polyamide such as is marketed under the trade name Kapton. The film may be 0.003 inches in thickness. Accurately defined thickness, dielectric constant and control of overlap is essential if effective cancellation of crosstalk is to be accomplished. The frames are secured to the film by an adhesive for example by providing each side of the film with an acrylic coating and securing the frame thereto by heat bonding. In the drawing it can be seen that the lateral extensions 16A, 16B, 16C & 15D where they overlie the portions 15A, 15B, 15C &15D respectively are shaded to aid identification.

The previously described arrangement is primarily concerned with capacitive cancellation which is most effective in cancellation of near end crosstalk (NEXT). In order to enhance far end crosstalk (FEXT) cancellation some degree of inductive cancellation is advisable. When a signal is transmitted over lines to a distance receiver, FEXT results in crosstalk appearing at the distant receiver when a signal is being received from a distant source, NEXT results in crosstalk at your receiver.

Figure 5:
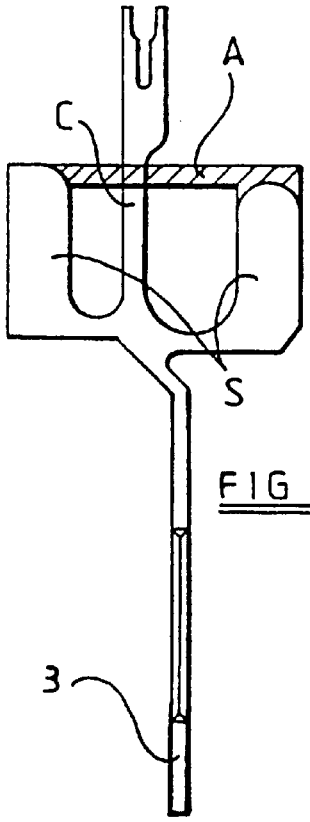
FIG. 5 is a plan view of a contact showing a modification.
Figure 6:
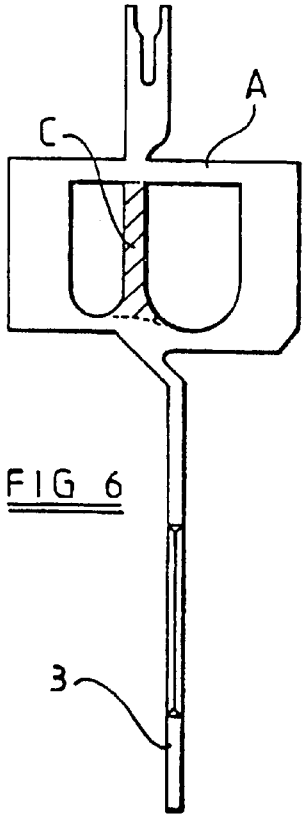
FIG. 6 is a plan view of the contact of FIG. 5 showing one step in the modification.
Figure 7:
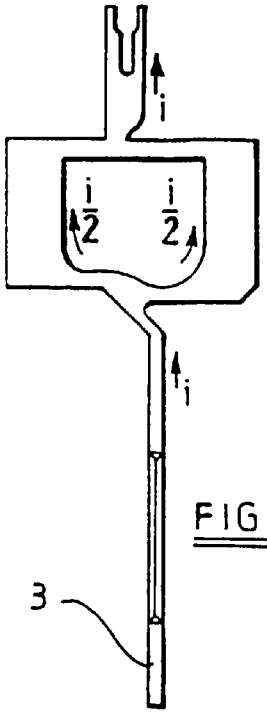
FIG. 7 is a plan view of the contact of FIG. 6 showing a further modification step.

FEXT cancellation is accomplished by arranging signal current for both the sending and receiving lines to flow in adjacent wires (or contacts) which therefore share a similar magnetic space. If the wire of one pair is coupled to a wire of another pair that is not normally adjacent in the connector then cancellation occurs. The following description shows that the same wires that couple capacitively can also couple inductively. If it is therefore arranged that signal current flows through the capacitor plates then both capacitive and inductive cancellation will occur. This is effected as follows. The contact illustrated in FIG. 5 has spurs or lateral extensions S and a signal current portion C. The shaded, or cross-latched, area shows a contact bridge that will be included to enable the signal current to flow through the capacitor plates. FIG. 6 shows this bridge added and the original current carrying portion C of the contact shaded which must be removed to arrange all the signal current to flow through the capacitor plates (half through each plate) FIG. 7 shows this final form.

Figure 8:
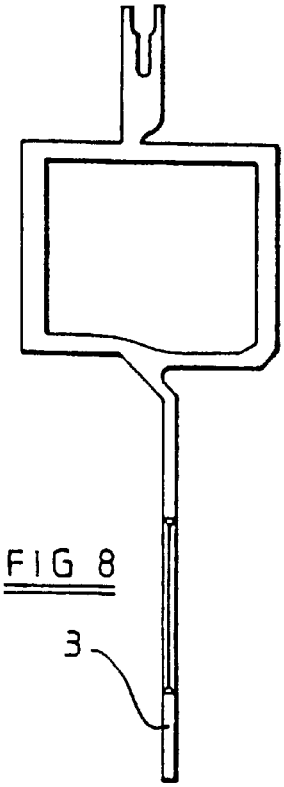
FIG. 8 is a plan view of the contact of FIG. 7 further modified.

It has been found advantageous to lengthen the portion of the contact (carrying half the current) and to narrow it to optimize the relationship between capacitance and inductance. This is shown in FIG. 8.

Figure 9:
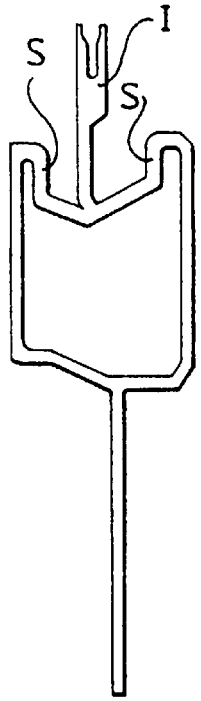
FIG. 9 is a plan view of a completed modification 20 of the contact illustrated in FIG. 8, and constructed in accordance with the present invention.
Figure 10:
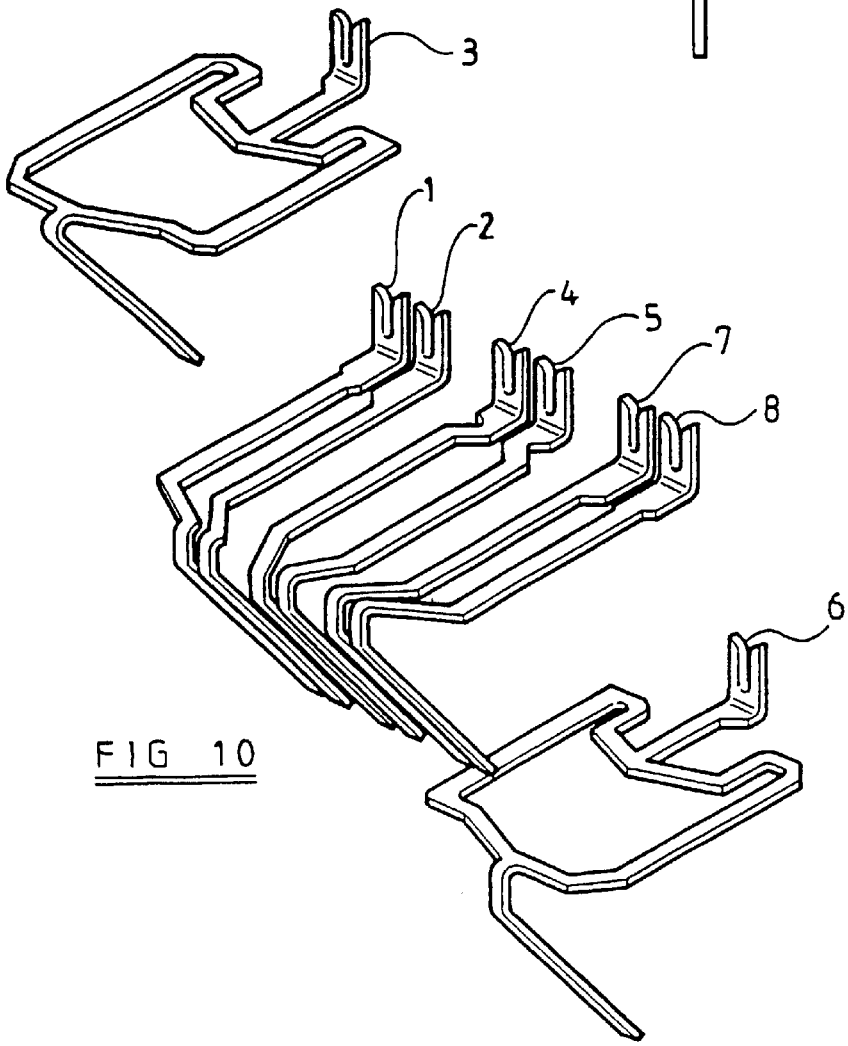
FIG. 10 illustrates individual contacts for an eight contact connector of the present invention.
Figure 11:
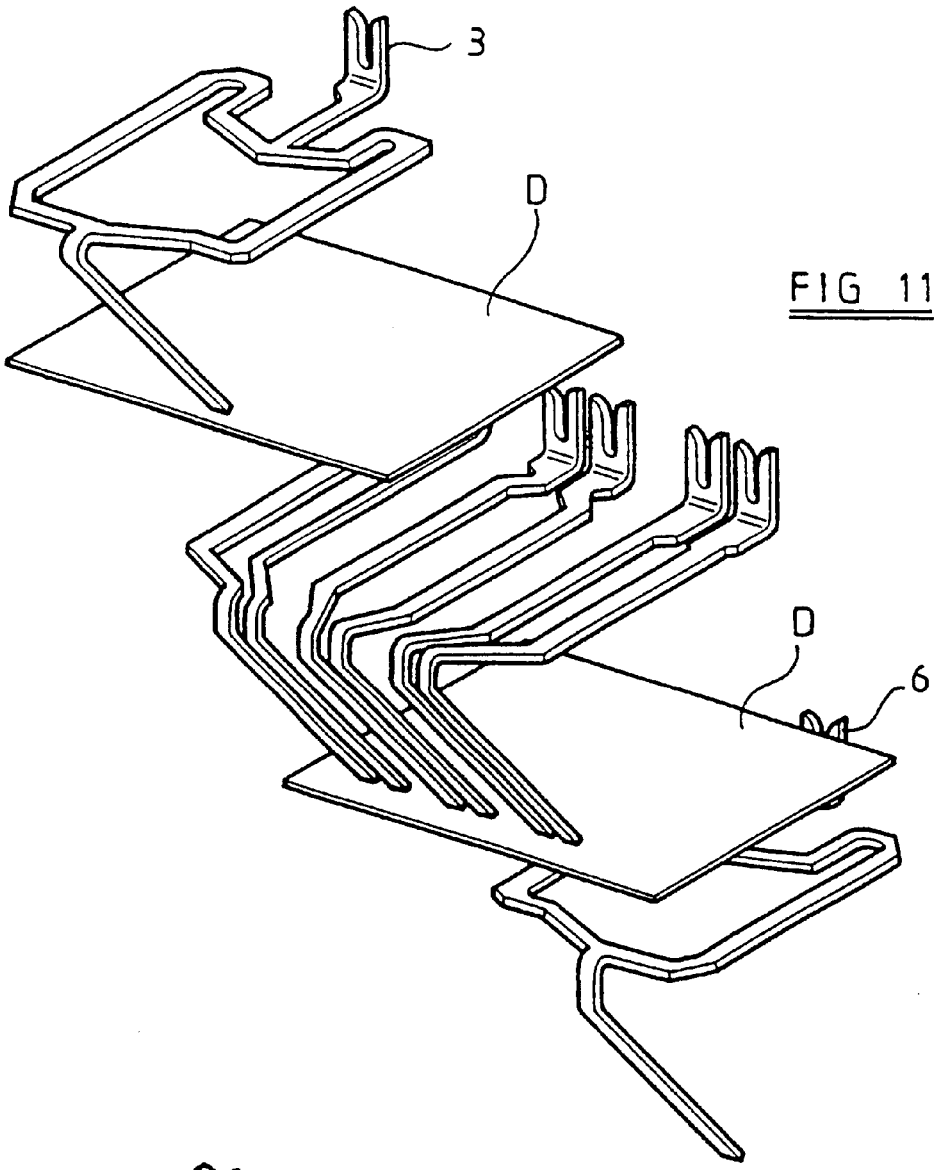
FIG. 11 shows the contacts of FIG. 10 with dielectric separators.
Figure 12:
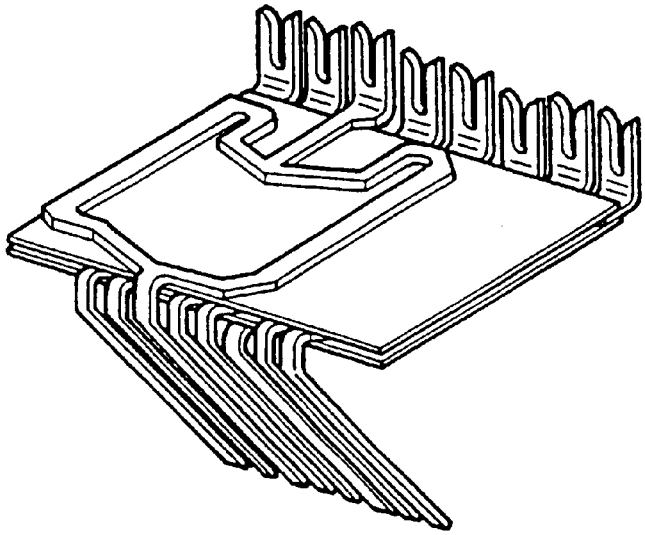
FIG. 12 shows an assembled disposition of the components of FIG. 11.

The wires that fit into the IDC (insulation displacement contact) portion of the contact generate crosstalk and balance the phase of this crosstalk to enhance crosstalk cancellation, This can be effected by lengthening the electrical path at the rear end of the connector by folding back the contact as shown in FIG. 9. This is the final design of one of the green contacts (contacts 3 and 6) for improvement of the connector. A contact as shown in FIG. 9 may be used for each of the contacts 3 and 6, as shown in FIG. 10, with one being an upside down, or mirror image, version of the other. FIG. 10, further shows the 6 other contacts 1,2,4,5,7 & 8 similar to the design of the prior art, where contacts 1,4,5 and 8 have been narrowed more in line with contacts 3 and 6. In the present arrangement, as shown in FIG. 11, there are three layers of contacts separated by two sheets of dielectric material D. Kapton is a suitable material for the dielectric. The assembled components are shown in FIG. 12.

There is equilibrium of current in each split half of both contacts 3 and 6.

The length and width of each half of the split contacts is preferably different to effect the optimum balance between inductive and capacitive cancellation.

The foldback enables phase cancellation without any need to lengthen the connector. The wires at the rear of the connector, that protrude through the IDC's are of a controlled length, due to the assembly tooling used to install the connector, and enable repeatable phase balancing as previously described. Contact 3 and 6 are identical mirror images of each other.

Although the contact 3 illustrated in FIG. 9 provides split paths and is intended for use in an eighth contact connector one side of the contact may be omitted to provide a single path. Such a construction may be advantageous with a four contact connector or for use with a group of four contacts in a multi-contact connector. The phase opposition enhancement capability provided by this invention will still result and provide a connector in accordance with the invention.

The two different constructions previously described have their lead frames bonded to the insulating film(s) and are then encapsulated in a plastics material. This can be seen from FIG. 13, where the group of encapsulated leads is identified by the number 20, and is of substantially rectangular block like form provided with eight parallel elongate slots 21 which are blind at one end and are for receiving insulated wires of a connecting cable. After encapsulation the rails of the lead frame are cut away to release the tails 12 and to open the end of the cut out 13 to define an insulation displacement fork 22. The fork end is bent upwardly at right angles as shown in the drawing and the tails are bent downwardly and backwardly so that they are inclined downwardly relative to the bottom of the block 20. It will be seen from the cut outs 13 in FIG. 2 that they are relatively displaced longitudinally of the terminals such that by appropriate cutting during the separating from the rails of the lead frame they define forks which project at different distances such that when bent there are rows of forks at different heights to facilitate attachment of insulated wires as will be hereinafter described.

Figure 13:
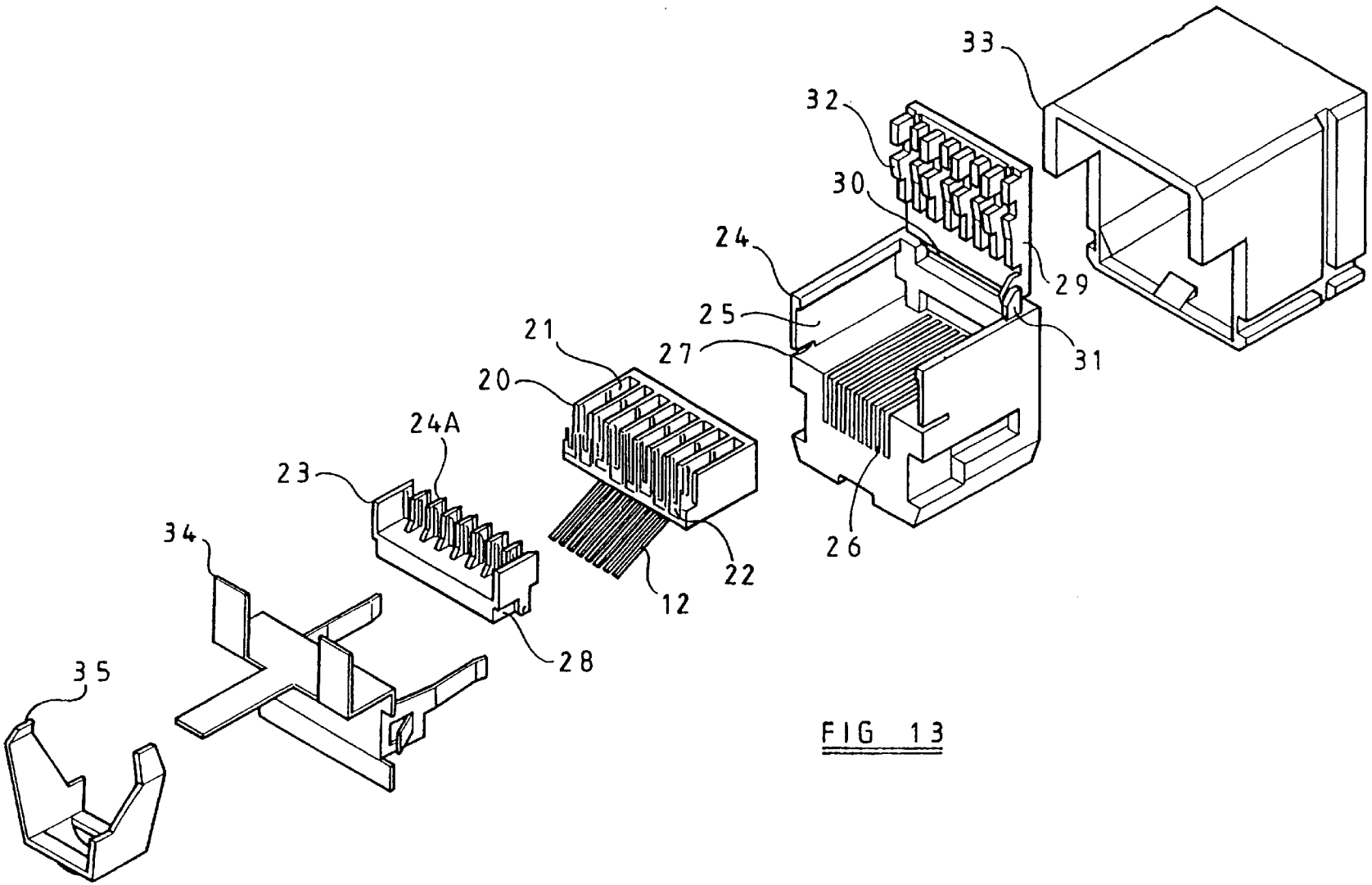
FIG. 13 is an exploded view showing the component parts of a complete connector employing the features of the invention.

Referring now to the exploded view of FIG. 13 the various additional components and their interconnection will now be described. A strain relief element 23 of shape similar to the rectangular block is provided and has slots 24A similar to slots 21 for receiving and supporting the insulation displacement connector forks 22 and the insulated wires. As can be seen the strain relief element forms effectively a continuation of the block when the insulation displacement forks are located in its slots.

A molded plastics housing 24 has a top provided at one side with a recess 25 which is shaped to permit slidable insertion of the block 20 and strain relief element 23. In the bottom of the recess there are provided eight parallel slots 26 which extend along the recess from the insertion end and which are spaced apart similarly to the spacing of the tails 12 where they emerge from the block 20. The slots extend through to a recess in the bottom of the housing which has at the other side of the housing an entry for receiving a cooperating connector. The slots 26 serve to each receive a tail 12, as the tail end of the block 20 is inserted into the recess 25, and to guide and separate the tails during and after insertion so that the tails are held in inclined disposition as contacts in the recess in the bottom of the housing for cooperation with a mating connector. The opposing walls of the recess 25 and the strain relief element are each provided with mutually engageable latch elements which in the described embodiments comprise inwardly tapered projections 27 on the opposing walls of the recess 25 and recesses 28 at opposite sides of the strain relief element into which the ends of the projections engage by snap action upon completion of insertion into the recess 25. Instead of providing the cooperating latch elements 28 on the strain relief element they may be provided on the sides of the block 20.

The housing 24 is also provided with an upwardly extending lid 29 which is formed during the moulding thereof and is linked with the housing top by a hinge line 30 and secured in the open position by a side connection portion 31 which is severed prior to closure of the lid. The lid is provided with eight elongate projections 32 which align with the slots 21, 24A and which serve to force insulated wires, when laid in the slot, into the insulation displacement connector forks 22 and to clamp the insulated wires when the lid is fully closed.

An outer shell 33 formed of metal or plastics and shaped to permit snug insertion of the hinge end of the housing 24 is also provided. This shell is effective to cause the connection of wires to the insulation displacement connectors, after laying in the slots 21 of the block 20 and slots 24A in the strain relief element after insertion in the housing 24, by just pushing the housing 24 into the shell. This forces the lid closed and causes the projections 32 to force the insulated wires into the forks 22 which effect insulation displacement and connection to the wire and also causes the insulation of the wires to be forced into the slots 24A of the strain relief element to aid retention of the wires. The shell acts as an electrical screen for the connector and the screening is further enhanced by a metal cable end screen 34 and securing clip 35.

The connector components assembled ready to receive insulated wires are shown in FIG. 14.

The lid at the inner body moulding may differ from that illustrated in that a bar perpendicular to the wire may be provided which will push the wires into the IDC slots.

It has been found that the best compensation for crosstalk can be effected if the overlapping lateral extensions 16A–16D and wide portions 15A–15D are provided as close as possible to the tails 12 (FIGS. 2, 3 and 4).

Although the embodiment described employs four pairs of wires it will be appreciated that the invention is effective for any connectors which include two or more pairs such as 3 & 6, 4 & 5 where crosstalk is required to be reduced and can be employed in connectors having a large number of pairs.

In this respect crosstalk can be a problem in whatever configuration the contacts are paired. For simplicity considering a four contact in line connector the contacts being numbered 1 to 4 in sequence then the pairs can be designated as 1 & 4, 2 & 3 (similar to 3 & 6, 4 & 5, in the previously described embodiment) which is the worst case, but could be designated as 1 & 2, 3 & 4 or 1 & 3, 2 & 4. In each case there are wires close to each other relating to a different pair and crosstalk reduction or cancellation in accordance with the techniques of this invention can be effected. Such configurations are considered to fall within the scope of this invention.

The principles of the invention are applicable to connectors having large numbers of contacts and it will be appreciated that there is the possibility of crosstalk between each pair of contacts and all of the other pairs of contacts and that the principles of this invention can be applied between each pair and any one or more of the other pairs of contacts.

Although the embodiment described employs lead frames mounted onto a dielectric film it will be appreciated that alternative constructions can be employed for example the contacts may be formed on opposite sides of a printed circuit board by etching or the contacts could be printed onto a dielectric film or board by for example screen printing a metallic pattern. Such configurations are considered to fall within the scope of this invention.

In order to clarify the operation of the embodiment of FIGS. 11 and 12 the following explanation may be helpful.

FIG. 15 shows two very short parallel twin wire transmission lines 40, 41 spaced physically close to each other. Crosstalk is generated between the lines. We will view the Near end crosstalk (NEXT). The crosstalk generated is directly proportional to the length of the close proximity run. A 90° phase shift exists between the transmitted signal TX and NEXT when measured at the point 42 i.e. the start of the close proximity parallel run of the transmission line. The opposite ends of the lines are coupled to twisted pairs which do not generate crosstalk.

Figure 17:
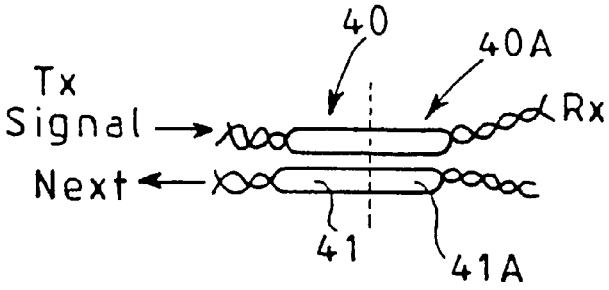
FIG. 17 illustrates schematically extended lines of FIG. 15.
Figure 18:
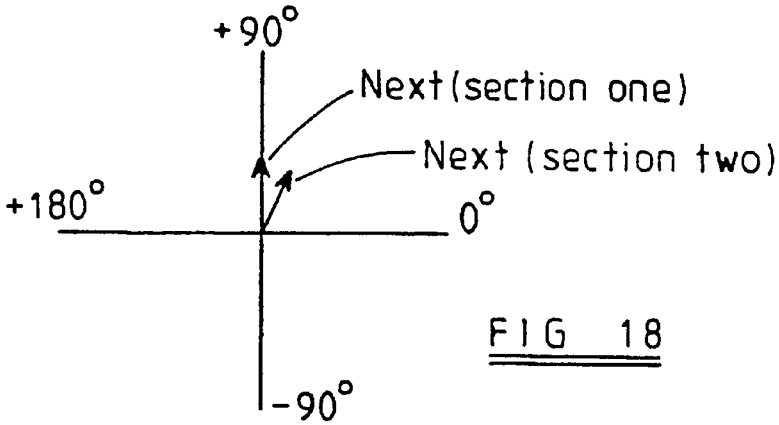
FIG. 18 illustrates the phase relationship of cross coupling between the transmission lines of FIG. 17.
Figure 19:
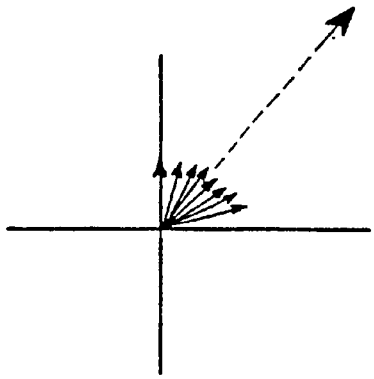
FIG. 19 illustrates the phase relationship of cross coupling between transmission lines of extended length.

For simplicity we will assume that the length of the line is short enough so as not to cause the phase considerations that follow and the phase relationship is as illustrated in FIG. 16. If another piece of Tx line 40A, 41A is added to the end of each of the lines 40 and 41 (of the same length), as illustrated in FIG. 17, the crosstalk generated in the second section 40A, 41A will have the same amplitude as that generated in the first section. However, the Tx signal, being propagated to the Rx will arrive at the second section of transmission line after it was at the first section of line due to propagation delays. This represents a phase lag or delay. This delayed Tx signal will introduce Next in the second section of the lower transmission line. This Next is then propagated towards the label "NEXT" and is also phase delayed by the propagation delay in the lower line 41. The emerging Next has been delayed by twice the propagation delay of the "CABLE' line length (once there plus once back). Adding the Next generated in the second section of line 40A, 40B gives the phase relationship illustrated in FIG. 18. (Note the phase is exaggerated for clarity). If many short sections of line were added the phase representation of each length would be as illustrated in FIG. 19 where each section, further away from the Tx signal, is subjected to a greater delay. Note that if all the vectors for all the sections are added (as would be the case in practice) the total would have an amplitude of substantially n (No. of sections) times the amplitude for each section. The phase of the TOTAL would be the average of the phases for each section and is substantially half the phase of the last section. Also note that the line would not be made up of sections—it would be continuous. The principle of sections is only used to aid the description. This could be summarized by stating that the crosstalk generated suffers a phase delay equal to the length of the line (i.e. ½× twice the length of the coupled portion of lines).

In practice the vector does not sit on the 90° axis. It suffers about a 10° delay in the connector described and sits at 80°.

If we now add a further length of transmission line to affect cancellation by allowing coupling of an opposite polarity line, this added length must be of the same length as the first to ensure that the crosstalk generated is equal in amplitude to that generated in the first length. The antiphase nature of crosstalk cancels the crosstalk from the first length. It is assumed that the coupling in the first length is the same as the second length. This cancellation is shown in FIG. 20.

Figure 20:
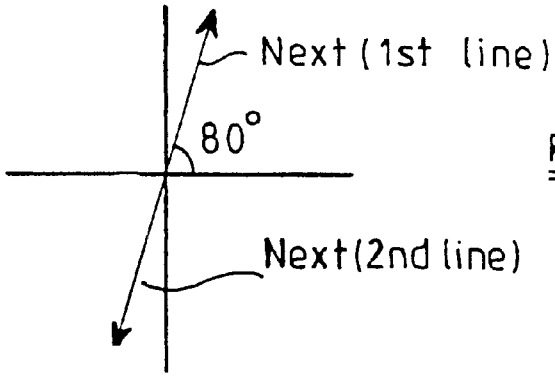
FIG. 20 illustrates the idealized phase cancellation introduced by extending the transmission lines.
Figure 21:
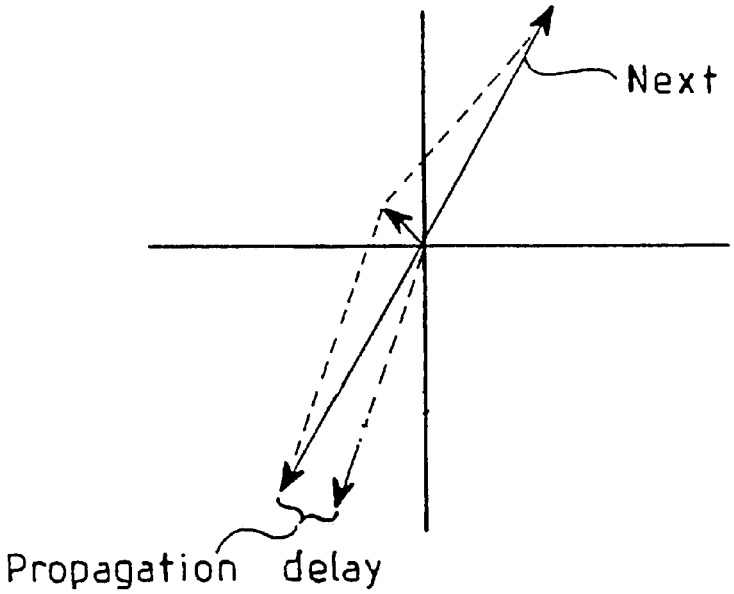
FIG. 21 illustrates the actual phase relationship introduced by extending the transmission lines.

Unfortunately, the idealized illustration in FIG. 20 does not result because the second section of line (the cancellation part) is subjected to propagation phase delay as well and the actual phase relationship is shown in FIG. 21. Due to the propagation delays described the resultant canceled crosstalk is a little better than −40 dB. Unless the phase delay is canceled CAT 6 specification performance cannot be accomplished.

Figure 22:
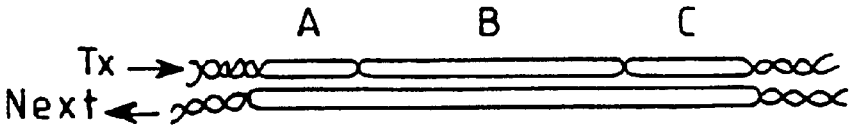
FIG. 22 illustrates schematically the various sections of connector coupling in a plug and socket connector.

Phase cancellation is provided as follows with reference to FIG. 22. Region A is the plug and the socket contacts making connection to the plug. This region produces crosstalk. Region B is part of the cancellation area of the socket and produces about twice the cancellation require to cancel region A. Region C is also in the socket, and produces crosstalk as at A. If the degree of crosstalk in each region (along with the correct phase relationship) is matched then absolute cancellation of NEXT occurs.

Figure 23:
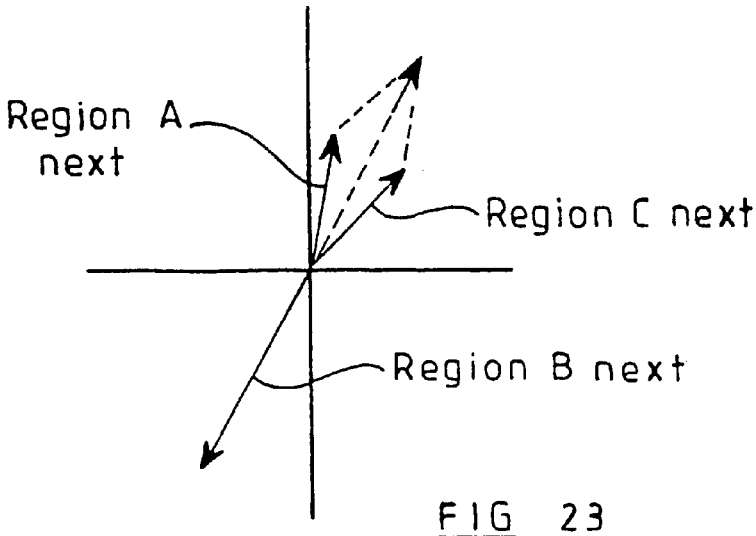
FIG. 23 illustrates phase balancing of the crosstalk.
Figure 24:
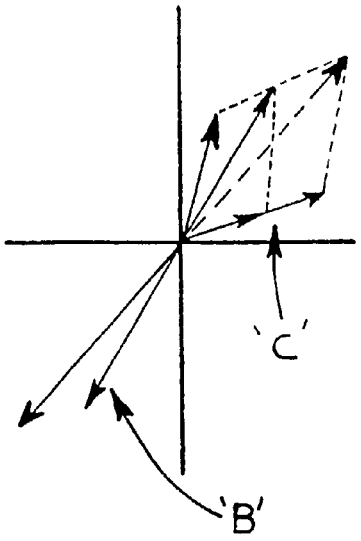
FIG. 24 illustrates crosstalk balancing by amplitude variation.
Figure 25:
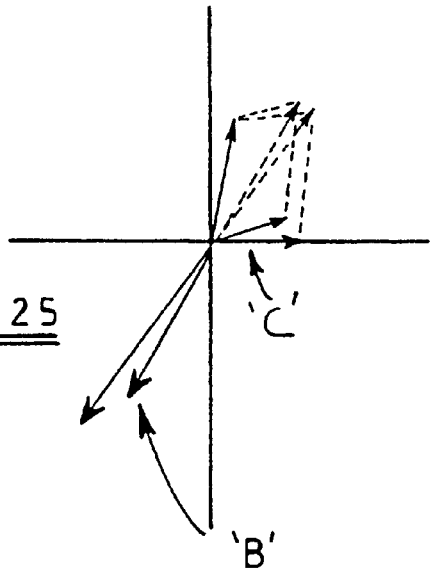
FIG. 25 illustrates crosstalk balancing by phase variation.
Figure 26:
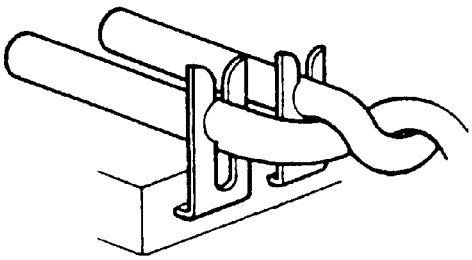
FIG. 26 illustrates schematically the IDC termination of a connector.

The vectors in FIG. 23 show this: If the correct balance is obtained then Region B vector is identical in amplitude and exactly 180° to the addition of A to C so absolute cancellation results. The resultant NEXT is zero. The illustration in FIG. 23 is symmetrical but this need not be the case. By varying amplitudes and phases the same end result can be obtained as illustrated in FIGS. 24 and 25. In the connectors described the crosstalk (mainly capacitive) is generated in the IDC area by the IDC's themselves and the wires protruding through them as illustrated in FIG. 26. For this crosstalk (as at C in FIG. 23) to effect the correct degree of phase cancellation it is necessary to lengthen the path between regions B & C (FIG. 22) to delay the C crosstalk as in FIG. 25. This is done by looping back the contacts.

What is claimed is:

1. A connector which includes a housing and a plurality of contacts mounted on said housing including first, second and third contacts, wherein said contacts have main portions that extend longitudinally and are spaced laterally, where said contacts each have a lateral width in a lateral direction and a thickness in a vertical direction, where said second contact lies laterally between said first and third contacts, and where there is crosstalk between said contacts and the connector is constructed to at least partially cancel said crosstalk, wherein:

said third contact has a main portion that is laterally spaced from said first and second contacts, and said third contact has an initial lateral extension that includes first and second connecting sections and an initial suppressing section extending between said connecting sections, said initial suppressing section extending parallel and adjacent to a section of said first contact, and said connecting sections of said third contact each connect an end of said suppressing section to a different part of said third contact main portion;

said connector includes a dielectric layer of small thickness lying between said suppressing section and said section of said first contact;

said first connecting section has a lengthening portion that lengthens a path of current flowing therealong;

said path of current flowing along said first connecting section has a length that is at least 110% of the direct lateral distance between said first and third contacts at a location where said first connecting section merges with said suppressing section and a location when said first connecting section merges with a part of said main portion of said third contact, to provide a longer current path to cause a phase delay.

2. The connector described in claim 1 wherein:

a first of said third contact main portion parts is a front part that extends in largely front and rear longitudinal directions, said front part having a rear end;

said first connecting section has a first connecting section part that extends largely in a first lateral direction from said front part rear end, a second connecting section part that extends primarily longitudinally frontward from said first connecting section part, and a third connecting section part that extends largely laterally from a front end of said second connecting section part to a front end of said suppressing section.

3. The connector described in claim 1 wherein:

each of said connecting sections forms a current path that is at least 110% of the direct lateral distance between said first and third contacts at corresponding locations where the corresponding connecting section merges with said suppression section and with the main portion of said third contact.

4. The connector described in claim 1 wherein:

said lengthening portion has a length at least 120% of said direct lateral distance.

5. The connector described in claim 1 wherein:

said contacts are each formed of sheet metal, said lateral extension and said section of said first contact lie in parallel horizontal planes that are spaced apart by less than the thickness of said sheet metal, and said current path length is at least 150% of said direct lateral distance.

6. The connector described in claim 1 wherein:

said contacts are formed of sheet metal;

of said section of said first contact and said suppressing section of said third contact, one of them has a predetermined thickness and has a width that is no more than twice said thickness.

7. The connector described in claim 1 wherein:

said suppressing section of said first contact has a predetermined thickness and has a width that is less than said thickness.

8. The connector described in claim 1 wherein said plurality of contacts includes at least a fourth and fifth contact, with said fourth contact lying laterally between said third and fifth contacts, and wherein:

said third contact has a secondary lateral extension with a secondary suppressing section extending parallel and adjacent to said fifth contact, with dielectric layer material between them, said secondary lateral extension having a pair of secondary connecting sections with said secondary connecting sections forming a current path that is at least 120% of the direct lateral distance between said third and fifth contacts.

9. A connector which includes a housing and a plurality of contacts mounted on said housing, wherein said contacts extend primarily longitudinally and are spaced apart laterally along most of their lengths, wherein said contacts each have a contact-section with a lateral width in a lateral direction and a thickness in a vertical direction, and wherein said plurality of contacts includes at least first, second and third contacts, where there is crosstalk between said first and third contacts, where most of said second contact lies laterally between said first and third contacts and wherein said connector is constructed to minimize crosstalk, wherein:

said third contact has a main portion and has a left lateral extension that includes a left suppressing section that extends parallel and adjacent to the contact section of said first contact, said lateral extension having opposite ends and a pair of connecting sections that each connects said third contact main portion to a corresponding end of said suppressing section;

a layer of dielectric material lying between said suppressing section and said first contact;

of said section of said first contact and said suppressing section, at least one of them has a width that is no more than twice its thickness along the entire length of the suppressing section, to thereby increase inductive coupling and reduce capacitive coupling.

10. The connector described in claim 9 wherein:

said contacts are formed of sheet metal with flat faces lying facewise against said dielectric material.

11. The connector described in claim 9 wherein:

said suppressing section has a width that is less than its thickness.

12. The connector described in claim 9 wherein:

a first of said connecting sections has a lengthening portion that is spaced from said first contact and that increases the length of a current path extending along first connecting section to at least 120% of the direct lateral distance between said first and third contacts where ends of said connecting section lie adjacent to said first and third contacts.

13. The connector described in claim 9 wherein:

said contacts are each formed of a piece of sheet metal that has been sheared from a larger piece of sheet metal, with each contact being of rectangular cross-section and having upper and lower surfaces that each has a width, and each contact having opposite sides that each has a height;

the width of each of said suppressing sections is no more than 180% of the height of the suppressing section.

14. The connector described in claim 9 wherein said plurality of contacts includes at least a fourth and fifth contact, with said fourth contact lying laterally between said third and fifth contacts, and wherein:

said third contact has a right lateral extension with a right suppressing section extending parallel and adjacent to a section of said fifth contact, with a second dielectric layer portion lying between said right suppressing section and said section of said fifth contact;

said right lateral extension including a pair of connecting sections that includes a first right connecting section that forms a current path that is at least 120% of the direct lateral distance between said third and fifth contacts at locations where said first right connection section merges with said right suppression section and with said main part of said third contact.

15. A connector which includes a housing and a plurality of contacts mounted on said housing, wherein said contacts are formed of sheet metal with top and bottom faces and extend primarily longitudinally and are primarily laterally spaced apart, as seen in a plan view, wherein said contacts each have a contact section with a lateral width in a lateral direction and a thickness in a vertical direction, and wherein said plurality of contacts includes at least three pairs of contacts, where there is crosstalk between a third contact and each of first and fifth contacts, where a second contact lies laterally between said first and third contacts and a fourth contact lies laterally between said third and fifth contacts, and where said connector is constructed to minimize crosstalk wherein:

said third contact has left and right lateral extensions that have connecting sections that respectively overlie said contact sections of said second and fourth contacts and that have suppressing sections that respectively extend parallel and adjacent to said first and fifth contact;

a first of said connecting sections of said left lateral extension has a fold-back part that extends primarily parallel to sections of said first and seconds contacts but that lies spaced and non adjacent to said first and second contacts and that is positioned to carry current in a direction primarily opposite to the direction of current flow through the suppressing section of said left lateral extension.

16. A connector which includes a housing and a plurality of contacts mounted on said housing, wherein said contacts extend primarily longitudinally and are primarily spaced laterally, as seen in a plan view, wherein said contacts each have a contact section with a lateral width in a lateral direction and a thickness in a vertical direction, and wherein said plurality of contacts includes at least three pairs of contacts, where there is crosstalk between a third contact and each of first and fifth contacts, where a second contact lies laterally between said first and third contacts and a fourth contact lies laterally between said third and fifth contacts, and where said connector is constructed to minimize crosstalk, wherein:

said third contact has left and right lateral extensions that have connecting sections that extend primarily laterally over said second and fourth contacts, respectively, and that have suppressing sections that extend parallel and adjacent to sections of said first and fifth contacts, respectively;

dielectric material lying between said extensions and said first, second, fourth, and fifth contacts;

of said suppressing sections and said contact sections of said first and fifth contacts, one has a width that is no more than twice its thickness along the entire length of the suppressing section, to maximize inductive coupling and minimize capacitive coupling.

* * * * *